US005389736A

United States Patent [19]

Ziemek et al.

[11] Patent Number: 5,389,736

[45] Date of Patent: Feb. 14, 1995

[54] POWER AND CONTROL CABLE WITH A TWO LAYER METALLIC SHEATH FOR MARINE APPLICATIONS

[75] Inventors: Gerhard Ziemek; Helmut Hildebrand, both of Langenhagen, Germany

[73] Assignee: Kabelmetal Electro GmbH, Hanover, Germany

[21] Appl. No.: 94,692

[22] Filed: Jul. 22, 1993

[51] Int. Cl.[6] ..... H01B 7/34

[52] U.S. Cl. ..... 174/36; 156/51; 156/54; 156/56; 174/102 R; 174/102 D; 174/105 R; 174/107

[58] Field of Search ..... 174/36, 102 R, 102 D, 174/105 R, 107; 156/51, 54, 56

[56] References Cited

U.S. PATENT DOCUMENTS

| | | | |
|---|---|---|---|
| 2,216,435 | 10/1940 | Eckel | 174/102 R |
| 3,340,353 | 9/1967 | Mildner | 174/106 R |
| 3,638,306 | 2/1972 | Padowicz | 174/107 |
| 4,378,462 | 3/1983 | Arnold, Jr. et al. | 174/105 R |
| 4,398,058 | 8/1983 | Gerth et al. | 174/107 |
| 4,477,298 | 10/1984 | Bohannon, Jr. et al. | 174/102 R |
| 4,487,641 | 12/1984 | Bohannon, Jr. et al. | 174/102 D |
| 4,569,704 | 2/1986 | Bohannon, Jr. et al. | 174/102 D |
| 4,595,431 | 6/1986 | Bohannon, Jr. et al. | 174/102 R |
| 4,622,092 | 11/1986 | Bohannon, Jr. et al. | 174/102 R |

*Primary Examiner*—Morris H. Nimmo

[57] ABSTRACT

In known cables, the cable core is surrounded by a metallic inner layer of a sheath, and the inner layer is enclosed by a corrugated metallic outer layer of the sheath. In these cables, a high resistance against corrosion and high temperatures at a good shielding of the electric conductors is not ensured.

The new cable (1) including the inner sheath layer (19) which is made of at least one flexible copper band (11) and defined by an electromagnetic shielding with a shielding attenuation from 80 to 115 dB, with the shield attenuation in this range being dependent from the wall thickness of the inner layer and rising monotonously with increasing wall thickness, and the outer sheath layer (27) which is made of a steel band and increases the high temperature resistance of the cable 1, has the advantages of a good temperature resistance even at high ambient temperatures, like e.g. in case of fire, and a high resistance with regard to corrosion.

The proposed cable is suitable in particular for use as power cable or control cable on ships.

17 Claims, 3 Drawing Sheets

POWER AND CONTROL CABLE WITH A TWO LAYER METALLIC SHEATH FOR MARINE APPLICATIONS

BACKGROUND OF THE INVENTION

The invention relates to a cable including a cable core with at least one insulated electric conductor and a sheath with a metallic inner layer and a metallic outer layer, with the inner layer surrounding the cable core and with the flexible outer layer enclosing the inner layer, and, further, relates to a method for making cable including a cable core with at least one insulated electric conductor and a sheath with a metallic inner layer and a metallic outer layer (DE-AS 10 31 391).

The invention is directed to the problem of providing a cable, particularly, for use as a power cable or control cable for ships, with a good shielding of the electric conductors, even at low frequencies, with thin wall thicknesses of the sheath, ensuring good temperature resistance also in case of fire and maintaining good flexural properties.

The above referenced publication discloses a cable with a cable core having a plurality of insulated electrical conductors, with at least the one cable core being surrounded by a metallic inner layer of the sheath. This inner layer is directly surrounded by a metallic corrugated outer layer of the sheath. The inner layer and the outer layer of the sheath may be made of any metal, in particular aluminum.

This known cable has the drawback that the selection of steel for the outer layer of the sheath provides good temperature and corrosion resistance; however, a sufficient electromagnetic shielding of at least the one insulated electric conductor is not ensured.

SUMMARY OF THE INVENTION

The cable according to the invention, with the inner sheath layer being made of one or more flexible copper strips providing electromagnetic shielding with a shielding attenuation of 80 to 115 dB which depends in this range on the wall thickness of the inner layer and monotonously increases with increasing wall thickness, and with the outer sheath layer being made of a steel strip. This design ensures that structural integrity and the electric properties of the cable are retained even at high external temperatures which may exceed the melting point of aluminum and may reach the melting point of stainless steel. Thus, it provides good temperature resistance also at high ambient temperatures, like e.g. in case of fire when using suitable insulating materials. Moreover, an especially effective shielding of at least the one electric conductor is attained in a simple manner through the inner copper layer and the outer steel layer of the sheath. This outer sheath according to the invention further ensures adequate corrosion ressistance of the cable and an effective protection against external damages. The cable according to the invention can be made in a simple and cost-efficient manner.

The method according to the invention makes possible a particularly simple and cost-efficient way of making a cable with an inner layer of a thin copper strip and an outer layer of a steel strip, by initially laying a copper strip in longitudinal direction of the cable around the cable core which forms the inner layer of the sheath. In a further method step, the outer layer of the sheath is formed by placing a steel strip in longitudinal direction of the cable about the inner layer of the sheath. Subsequently, the two opposing edges of the steel strip which extend in longitudinal direction of the cable are welded together forming a straight seam. Finally, the outer sheath layer is corrugated.

The features as set forth in the dependent claims cover advantageous further developments and improvements of the cable as recited in claim 1 and the method as recited in claim 16 for making a cable.

For adequate shielding of the electrical conductors of the cable it is advantageous for a single copper layer structure to select a ratio of the wall thickness of the inner copper envelope to its mean diameter such that with increasing shielding attenuation within the stated attenuation range a minimum is attained. This minimum is given by the slope of a straight line representing in a system of cartesian coordinates the wall thickness as one coordinate, and the mean envelope diameter as the second coordinate.

For the same reason it is also advantageous, in a two layer copper structure, to select a ratio of the wall thickness of the copper layer to its mean diameter such that with increasing shielding attenuation a maximum is obtained. Such maximum value is represented by the slope of a straight line representing, in a system of cartesian coordinates, the wall thickness of the inner layer as one coordinate and its mean diameter as the second coordinate whereby the slope of this straight line is much greater than the slope of the straight line for the single-layer copper structure.

For providing a particular corrosion-proof outer layer of the sheath and for prevention of contact corrosion between the outer layer and the inner layer of the sheath, it is advantageous to make the outer sheath layer of stainless steel with an inner insulating layer of an electrically non-conducting material.

The provision of the inner sheath layer with two superimposed layers of one or more copper strips at a ratio of the mean diameter relative to the wall thickness of the inner layer between about 50 and 100 improves the flexural properties of the cable according to the invention.

It is advantageous in connection with accomplishing a particular simple production of a cable according to the invention with an insulating layer arranged between the inner layer and outer layer of the sheath, when making the insulating layer of electrically non-conducting material in form of a coating of the copper sheath layer.

In order to ensure a tight and secure grip of the copper strip on the cable core during corrugation of the outer sheath layer, it is advantageous to provide the corrugation of the outer sheath layer in direction of the overlap of at least the one copper strip.

A simplified example of the embodiment of the invention is illustrated in the drawing and explained in detail in the following description.

DETAILED DESCRIPTION OF PREFERRED EMBODIMENTS

Figure 1:
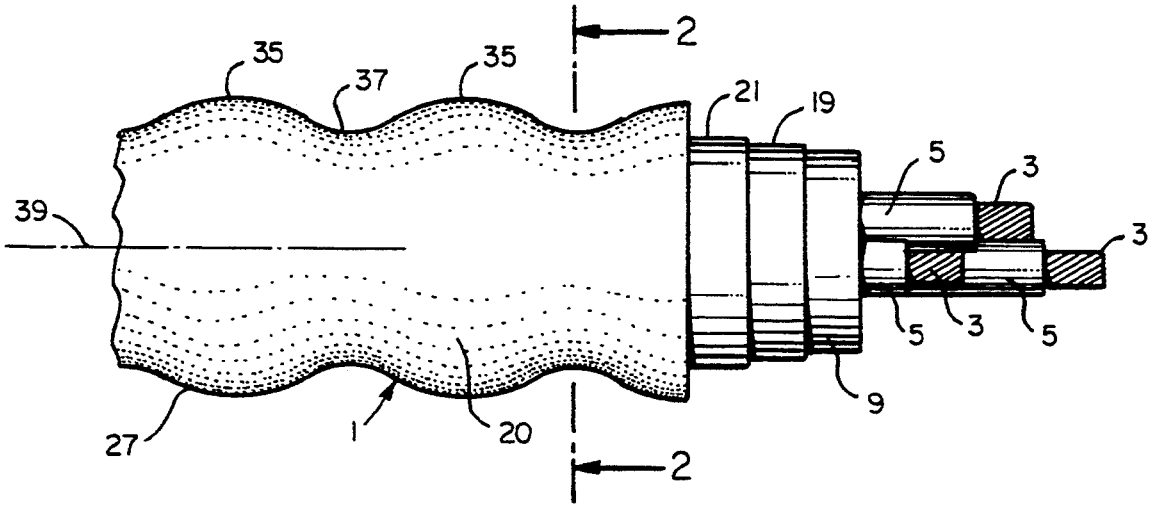
FIG. 1 shows an exemplified embodiment of a cable in accordance with the invention.
Figure 2:
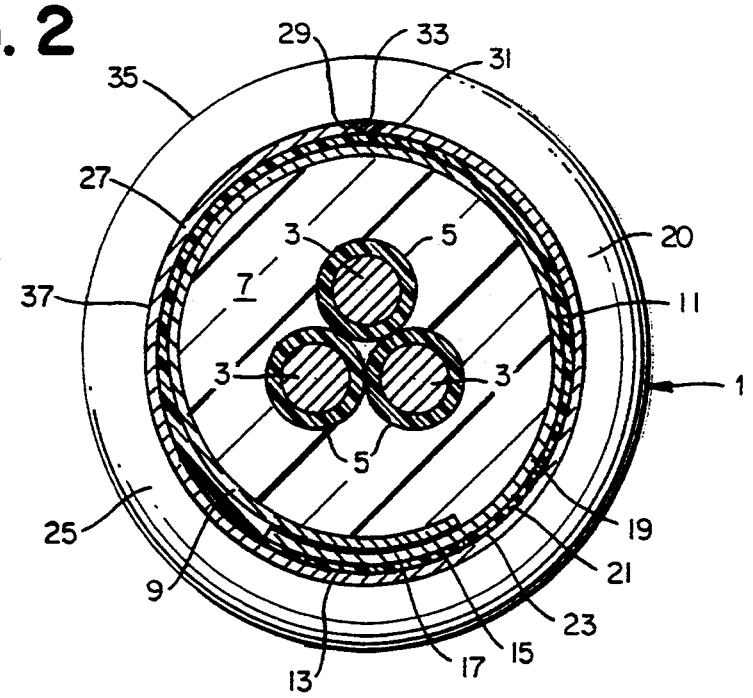
FIG. 2 shows a greatly enlarged sectional view along the line II—II in FIG. 1.

The cable illustrated by way of example in FIGS. 1 and 2 serves e.g. for use as power cable or control cable for ships. The cable 1 has e.g. three electric conductors 3 which are each surrounded by an insulation 5. The electric conductors 3 are embedded together in an extruded plastic sheath 7 to thereby provide e.g. an approximately cylindrical cable core 9 which defines a longitudinal axis 39 and includes the electric conductors 3.

Placed about the cable core 9 in longitudinal direction of the cable 1, i.e. parallel to the longitudinal axis 39, is a thin, flexible copper strip 11 which is for example of such a width as to result in longitudinal direction of the cable 1 in an overlap 13 in areas 15 and 17 which extend parallel to the longitudinal axis 39. In this manner, the copper strip 11 forms a cable core surrounding inner layer 19 of a sheath 20 of the cable 1.

It is likewise possible to form the inner layer 19 of the sheath 20 of several thin copper tapes 11. The bending characteristics of the cable 1 are improved if, for example, the inner layer 19 is made up of two copper strips resulting in the same total thickness of the copper tape 11 and the same electrical conductivity. Instead of a single copper tape 11 of 0.1 to 0.7 mm thickness the layer 11 can be built up of two copper tapes with 0.2 to 0.5 mm thickness.

The inner layer 19 of sheath 20 of cable 1 is enclosed in an insulating layer 21, made of an electrically non-conductive material. This insulating layer 21 in the example shown in FIG. 1 and 2 consists of insulating foil 23 placed around the inner layer 19 of sheath 20 in longitudinal direction in cable 1, whereby the edges of the foil overlap. The edges of the foil 23 can be glued together or made form-stable through heat treatment. The insulating foil can be coated with a layer of a material which expands upon entry of water into cable 1, preventing a lengthwise propagation of the water, thus ensuring the proper functioning of the cable.

Instead of using a separate insulating foil 23, it is also possible to make the insulating layer 21 in form of copper tapes 11 which are at least on one side coated with an electric insulation, e.g. copolymer of polyethylene.

A steel strip 25 e.g. made of stainless steel is laid in longitudinal direction of the cable 1 in parallel relationship to the longitudinal axis 39 around the inner layer 19 of the sheath 20 together with its insulating layer 21 to provide a tubular outer layer 27 of the sheath 20. The strip thickness of the steel strip ranges e.g. between 0.25 and 0.8 mm depending upon the diameter of the cable 1. The longitudinal edges 29, 31 of the steel strip 25 which abut in circumferential direction and extend parallel to the longitudinal axis 39 of the cable 1 are offset in circumferential direction of the cable 1 relative to the overlap 13 of the copper strip 11, e.g. extend diametrically opposite to the overlap 13, and are securely and tightly connected together by a welded straight seam 33. In order to ensure flexibility of the sheath 20 and thus good flexural properties of the cable 1, the outer layer of the sheath 20 with a longitudinally welded seam is corrugated in longitudinal direction of cable 1. In the illustrated exemplified embodiment, the wave crests 35 and the wave troughs 37 extend for example precisely perpendicular to the longitudinal axis 39 of the cable 1 so that the cable 1 includes a longitudinal water-tight parallel corrugation or ring corrugation. It is also possible to provide the sheath 20 of the cable according to the invention with a helical corrugation. The corrugation of the outer layer 27 of the sheath 20 results also in a corrugation of the inner copper layer 19 and of the insulating layer 21. In this manner, the inner layer 19 is securely fixed around cable core 9.

It is also possible to provide the insulating layer 21 in form of a steel strip 25 which faces the inner layer 19 of the sheath 20 and is coated with an electrically insulating material. In any event, the insulating layer 21 is arranged to separate at least the one copper strip 11 and the steel strip 25 from each other in such a manner that a metallic contact and thus a danger of contact corrosion is eliminated between the copper strip 11 and the steel strip 25.

The design of the outer layer 27 of the sheath 20 in form of a steel strip 25 increases the high-temperature resistance of the cable 1 in such a way that the structure and the electric properties of the cable 1 are retained even at high external temperatures, like e.g. in case of fire, which may exceed the melting point of aluminum and may reach the melting point of stainless steel.

The inner copper layer 19 of the sheath 20 of the cable 1, which serves e.g. as power cable or control cable, provides even at low frequencies and thin wall thicknesses of the sheath 20 a good shielding of the electric conductors 3 which cannot be achieved with cables which merely have a sheath of stainless steel.

The improved electromagnetic shielding effect of the cable 1 according to the invention with the inner copper layer 19 and the outer stainless steel layer 27 of the sheath 20 is illustrated by way of the following example in which at a frequency of 100 kHz a shielding attenuation of as $\leqq 85$ dB corresponding to a transfer impedance RK of $\geqq 2.8$ m/m is obtained. Shielding attenuation and transfer impedance characterize the shielding effect of the sheath 20. The outer layer 27 is a corrugated pipe of stainless steel with the following properties:

greatest outer diameter: 38 mm
smallest inner diameter: 30 mm
wall thickness $s_1$: 0.5 mm
specific resistivity $\rho_1$: 0.6 $\Omega \cdot mm^2/m$
relative permeability $\mu$: 1.

Arranged between the cable core 9 and this outer layer 27 is the tubular inner copper layer 19 of the sheath 20 at e.g. a wall thickness $s_2 = 0.2$ mm.

The following table illustrates the transfer impedance of the outer layer 27 and the inner layer 19 of the sheath 20 as well as the resulting transfer impedance of both layers 19, 27 of the sheath.

| Frequency | Transfer Impedance $R_K$ (mΩ/m) | | |
|---|---|---|---|
| (MHz) | Steel | Copper | resulting |
| 0.1 | 13 | 1.0 | 0.93 |
| 0.1 | 13 | 0.98 | 0.91 |
| 0.2 | 13 | 0.93 | 0.87 |
| 0.5 | 13 | 0.71 | 0.67 |
| 1 | 13 | 0.42 | 0.41 |
| 2 | 11 | 0.17 | 0.17 |
| 5 | 6.2 | 0.023 | 0.023 |
| 10 | 2.6 | 0.002 | 0.002 |
| 20 | 0.69 | $5.4*10^{-5}$ | $5.4*10^{-5}$ |
| 50 | 0.039 | $3.4*10^{-8}$ | $3.4*10^{-8}$ |

The following equation applies for the interrelation between transfer impedance $R_k$ and shielding attenuation $a_s$:

$$a_s = 20 \cdot \log (R_k \cdot 1/z) \text{ in dB}$$

wherein $R_k$—transfer impedance in Ω/m

Z—characteristic impedance of the measuring device for $R_k$ in Ω l—cable length to which $a_s$ is related, in m.

This equation shows that the outer layer 27 of stainless steel has only a shielding attenuation $a_s$ of 71.7 dB at 100 kHz, while the inner copper layer 19 of the sheath 20, having a thickness of e.g. of 0.2 mm, increases the shielding attenuation to 94.8 dB. The inner layer 19 thus results in a significantly improved shielding of the electric conductors 3 of the cable 1.

For the construction of the cable 1 according to the invention, it is of great importance to determine the wall thickness $s_2$ of the inner copper layer 19 of the sheath 20 in dependence from the demanded shielding attenuation $a_s$ or from the transfer impedance $R_k$, respectively, which both are used for characterization of the shield effect of a cable screen. In case the length 1 of a cable is small relative to the considered wave length, the following equation applies for the transfer impedance $R_k$, with Z representing the characteristic impedance of the measuring arrangement:

$$R_k = Z/l \cdot 10^{-as/20} \text{ in } \Omega/m$$

In the range of lower frequencies, which is considered here, the transfer impedance $R_k$ is identical with the dc resistance of the sheath 20. Thus, the following equation applies:

$$R_k = \frac{R_1 \cdot R_2}{R_1 + R_2} \text{ in } \Omega/\text{m}$$

wherein $R_1$—resistance of the outer layer 27 of steel $R_2$—resistance of the inner layer 19 of copper and $$R_1 = \frac{\rho_1 \cdot k_1}{D_1 \cdot \pi \cdot s_1} \text{ in } \Omega/\text{m } (s_1 < D_1)$$

$$R_2 = \frac{\rho_2}{D_2 \cdot \pi \cdot s_2} \text{ in } \Omega/\text{m } (s_2 < D_2)$$

wherein $\rho_1$—specific resistivity of steel in $\Omega \cdot mm^2/m$ $\rho_2$—specific resistivity of copper in $\Omega \cdot mm^2/m$ $D_1$—mean diameter of the outer layer 27 of the sheath 20 in mm $D_2$—mean diameter of the inner layer 19 in mm $s_1$—wall thickness of the outer layer 27 in mm $s_1$—wall thickness of the inner layer 19 in mm $k_1$—deflection factor of the outer layer 27 depending on the corrugation.

Assigning typical values for $\rho_1$, $k_1$, $D_1$ and $s_1$ shows that the resistance $R_1$ of the outer steel layer 27 of the sheath 20 is clearly greater than the resistance $R_2$ of the inner copper layer 19. Without creating an inadmissibly great deviation during the calculation, the effect of the outer layer 27 on the transfer impedance $R_k$ of the shield can be neglected, as already shown by the previous table so that the following equation applies:

$$R_k \approx R_2 = \frac{\rho_2}{D_2 \cdot \pi \cdot s_2} \text{ in } \Omega/\text{m}$$

Through transformation, the following equation applies for the wall thickness $s_2$ of the inner layer 19 of the sheath 20:

$$s_2 = \frac{\rho_2 \cdot 10^{as/20}}{D_2 \cdot \pi \cdot Z} \cdot l \text{ in mm}$$

Considering $$\rho_2 = 0.0175 \frac{\Omega \cdot mm^2}{m}$$

for copper, l = 1 m and Z = 50 Ω, the following equation finally applies $$s_2 = 1.1 \cdot \frac{10^{as/20}}{D_2} \cdot 10^{-4} \text{ in mm}$$

Depending on the demanded shielding attenuation $a_s$ which should range between 80 and 115 dB in the cable according to the invention and on the diameter $D_2$ of the inner layer 19, the following wall thicknesses $s_2$ as indicated in the following table are obtained for the incorporated inner copper layer 19 of the sheath 20.

| $a_s$ | $s_2$ (mm) for $D_2$ (mm) | | | | | | | |
|---|---|---|---|---|---|---|---|---|
| (dB) | 10 | 20 | 30 | 40 | 50 | 60 | 70 | 80 |
| 80 | 0.11 | — | — | — | — | — | — | — |
| 85 | 0.20 | 0.10 | — | — | — | — | — | — |
| 90 | 0.35 | 0.17 | 0.12 | — | — | — | — | — |
| 95 | 0.62 | 0.31 | 0.21 | 0.15 | 0.12 | — | — | — |
| 100 | — | 0.55 | 0.37 | 0.28 | 0.22 | 0.18 | 0.16 | 0.14 |
| 105 | — | 0.98 | 0.65 | 0.49 | 0.39 | 0.33 | 0.28 | 0.24 |
| 110 | — | — | — | 0.87 | 0.70 | 0.58 | 0.50 | 0.44 |
| 115 | — | — | — | — | — | 1.03 | 0.88 | 0.77 |

Figure 5:
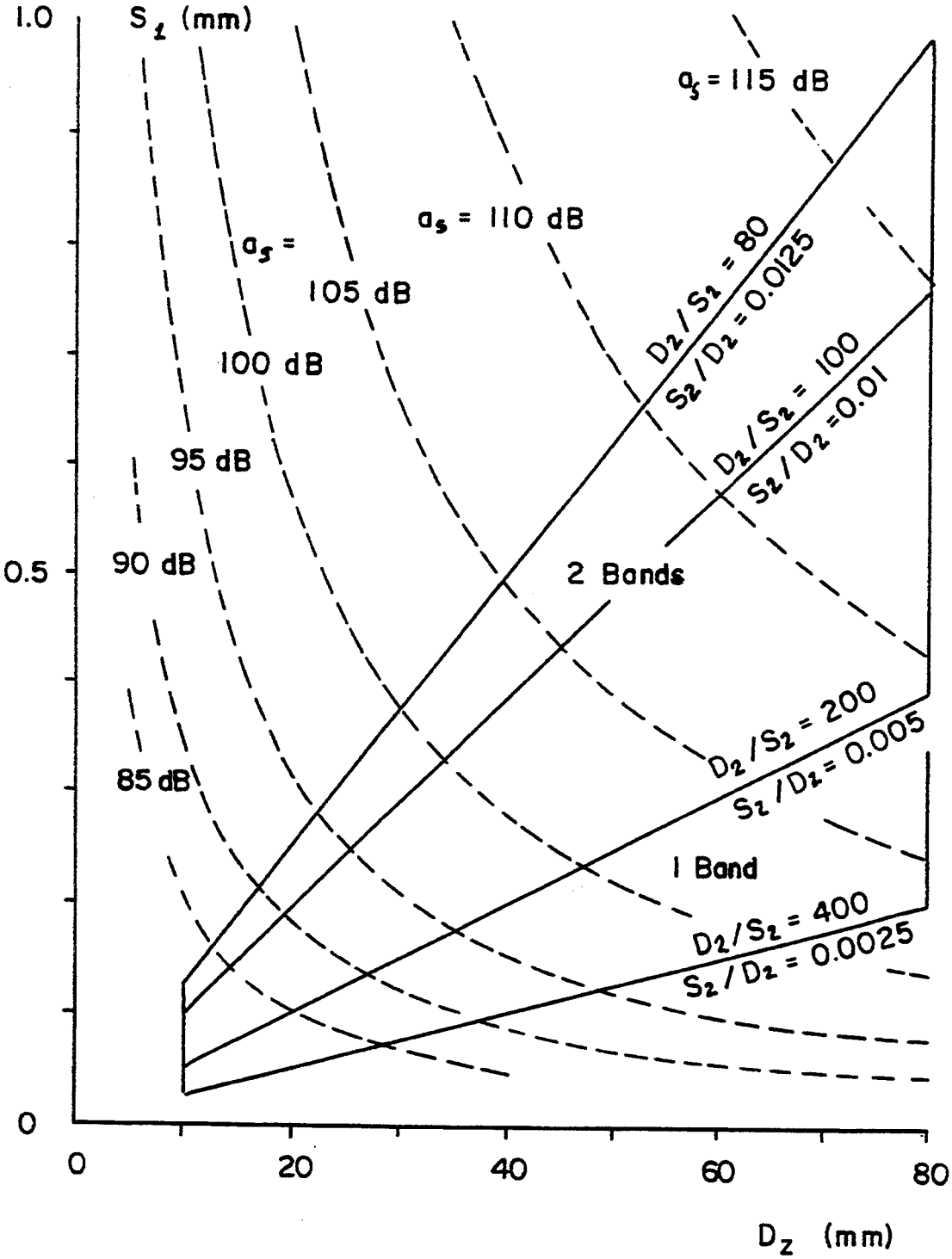
FIG. 5 shows a graph, with the wall thickness of the inner sheath layer plotted as a function of the diameter.

The values of the wall thickness $s_2$ of the inner layer 19 of the sheath 20 as indicated in the table are plotted in the diagram as illustrated in FIG. 5 in a cartesian coordinate system as the first coordinate in dependence of the diameter $D_2$ of the inner layer 19 as second coordinate with the parameter of the demanded shielding attenuation $a_s$. Included are also lines of constant ratios of the mean diameter $D_2$ to the wall thickness $s_2$ of the inner layer 19 of the sheath 20 as well as of the wall thickness $s_2$ to the mean diameter $D_2$. In order to ensure a simple making and handling of the cable 1 according to the invention, the ratio between the mean diameter $D_2$ and the wall thickness $s_2$ is selected in the area between 50 and 400.

In order to ensure a sufficient electromagnetic shield of at least the one electric conductor 3 by means of the inner layer 19 of the sheath 20 which is made of at least one copper strip 11, the inner layer 19 which is provided for shielding has a shield attenuation $a_s$ of 80 to 115 dB, with the shield attenuation $a_s$, as shown in FIG. 5, being greatly dependent in this range of the shield attenuation on the wall thickness $s_2$ of the inner layer 19 and rising monotonously with increasing wall thickness $s_2$.

In order to obtain a good flexibility of the cable 1, it is necessary to make the inner layer 19 of the sheath 20 for a greater wall thickness $s_2$ in form of several layers e.g. of a copper strip 11. It has been shown that a good flexibility of the cable 1 is ensured when the inner layer 19 is made of two superimposed layers of copper strip 11 with a ratio of the mean diameter $D_2$ relative to the wall thickness $s_2$ between about 50 and 100, while at ratios of $D_2$ to $s_2$ between about 100 and 400 a single layer structure of the inner layer 19 of the sheath 20 is sufficient.

The ratio of the wall thickness $s_2$ of the inner copper layer 19 of the sheath 20 relative to its mean diameter $D_2$ as a function of increasing shield attenuation $a_s$ e.g. within the range of the shield attenuation $a_s$ of 85 to 115 dB, (with a single layer structure of the inner layer 19) has a minimum value which is defined by a first straight line which e.g. represents a ratio of the wall thickness $s_2$ to the mean diameter $D_2$ of 0.0025. With a two-layer structure of the inner layer 19 of the sheath 20, the ratio of the wall thickness $s_2$ of the inner copper layer 19 to its mean diameter $D_2$ as a function of increasing shield attenuation $a_s$ e.g. within the stated range of the shield attenuation $a_s$ of 85 to 115 dB, a maximum value is obtained which is defined by the slope of a second straight line of constant ratio of the wall thickness $s_2$ relative to the mean diameter $D_2$ of for example 0.0125, with the slope of the second straight line significantly greater than the slope of the first straight line ($s_2/D_2=0.0125$ as compared to $s_2/D_2=0.0025$).

For the installation of the cable according to the invention, with at least one coated copper strip 11 care must be taken that the insulating layer 21 is removed at the ends of the cable and that the inner layer 19 is connected with the outer layer 27 of the sheath 20 in an electrically conducting manner since outer layer 27 and inner layer 19 together effect the shielding of the electric conductors 3.

Figure 3:
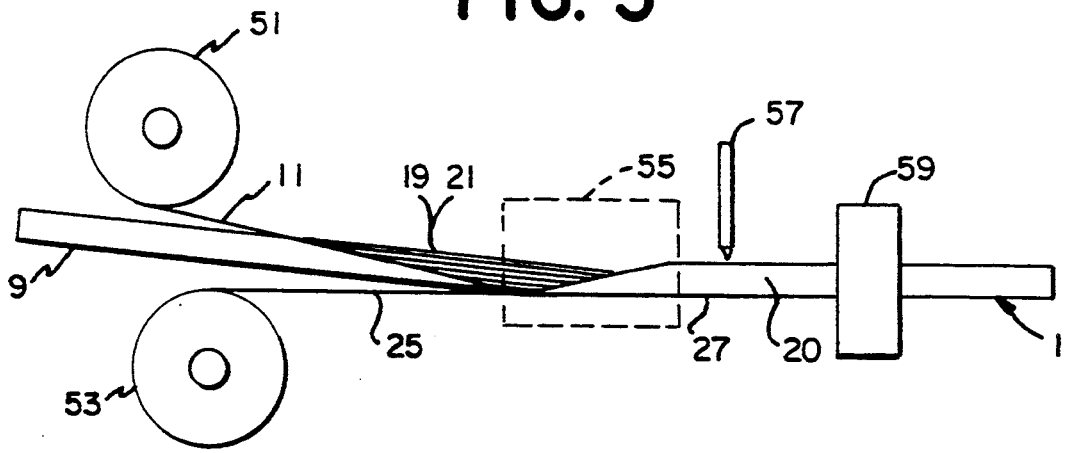
FIG. 3 shows a first apparatus for making a cable according to the invention.
Figure 4:
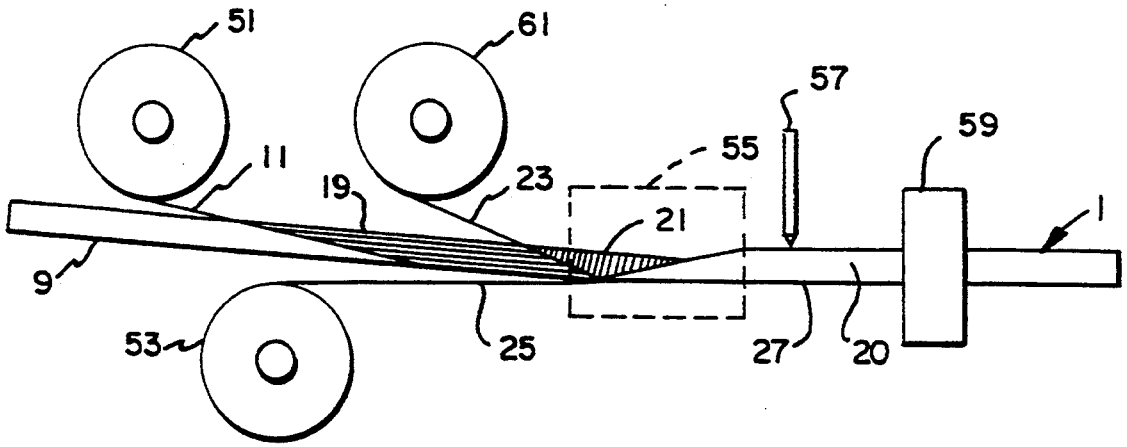
FIG. 4 shows a second apparatus for making a cable according to the invention.

FIGS. 3 and 4 illustrate apparatuses for making a cable in accordance with the invention. A first exemplified embodiment of such an apparatus is illustrated in FIG. 3, wherein the inner layer 19 of the sheath 20 of the cable 1 is made by feeding a copper tape 11 from a tape dispenser 51, and placing it in logitudinal direction of the cable 1 about the cable core 9. The copper strip 11 used here is for example provided with an insulating layer 21 of plastic material so that a separate application of an insulating foil 23 onto the inner layer 19 of the sheath 20 is not necessary. In a subsequent process step, a steel strip 25 is pulled from a reel tape dispenser 53 and applied in longitudinal direction of cable 1 about the inner layer 19 in a forming die 55 and formed into a tubular outer layer 27 of the sheath 20. By means of a welding unit 57, the longitudinal edges 29, 39 of the steel strip 25, which abut each other and extend in longitudinal direction of the cable 1, are welded tightly together forming straight seam 33. Finally, the outer layer 27 of the sheath 20 of the cable 1 is corrugated by means of a corrugating device in circumferential direction from the first overlap area 15 to the second overlap area 17 of the copper strip 11 i.e. in direction of the overlap 13.

The second exemplified embodiment of an apparatus for making a cable according to the invention, as illustrated in FIG. 3 differs merely by the fact that the copper strip 11 is not coated with an insulating layer 21, but an insulating foil 23 made e.g. of plastic material and stored in a dispenser 61 is applied in a further method step onto the inner sheath layer 19 which is made of the copper strip 11 or copper strips 11 in longitudinal direction of the cable 1, thus providing an insulating layer 21 over the inner layer 19. Subsequently, a steel strip 25 is formed into the outer layer 27 of the sheath 20 of cable 1.

The cable 1 according to the invention having at least one insulated electric conductor 3 which includes an inner layer 19 made of copper strip and having an electromagnetic shielding of the electric conductors with a shielding attenuation of 80 to 115 dB, and an outer layer 27 made of a steel strip 25, in addition to good temperature resistance, offers the advantage of great corrosion resistance and resistance against mechanical damages as well as especially good electromagnetic shielding of the conductor(s) 3.

What is claimed is:

1. A cable comprising:

a core having at least one insulated electric conductor;

an inner envelope in the form of at least one copper strip surrounding said core, the inner envelope providing electromagnetic field shielding within an attenuation range of 85 to 115 dB, the amount of attenuation in this range being dependent upon the thickness of the inner envelope and increasing monotonically with increasing thickness;

an outer envelope of stainless steel surrounding and enclosing the inner envelope, the steel strip extending in the longitudinal direction of the cable with welded abutting edges extending in the longitudinal direction of the cable, the outer envelope enabling the cable to retain its structural and electrical integrity when subjected to external temperatures which approach the melting point of stainless steel; and an electrically non-conductive layer disposed between the inner and outer envelopes and preventing any metallic contact between the inner and outer envelopes.

2. The cable of claim 1 wherein the thickness of the inner envelope is within the range 0.10 to 1.0 millimeter and increases with increasing cable diameter.

3. The cable of claim 1 wherein the thickness of the outer envelope is within the range 0.25 to 0.8 millimeter and increases with increasing cable diameter.

4. The cable of claim 1 wherein the at least one copper strip extends around the longitudinal axis of the cable, the width of the copper strip being so chosen that its longitudinal edges are overlapped in the peripheral direction of the cable.

5. The cable of claim 4 wherein the abutting edges of the steel strip are offset from the overlapped edges of the copper strip.

6. The cable of claim 1 wherein the outer layer is helically corrugated.

7. The cable of claim 1 wherein the outer layer has corrugations in the form of parallel rings.

8. The cable of claim 1 wherein the ratio of the average diameter of the inner envelope to that of the wall thickness of the inner envelope falls within the range of 50 to 400.

9. The cable of claim 8 wherein the inner envelope is a single copper strip and the ratio falls within the range 100 to 400.

10. The cable of claim 8 wherein the inner envelope consists of two copper strips disposed one above the other and the ratio falls within the range 50 to 100.

11. The cable of claim 1 wherein, the inner envelope consists of two strips, an inner and an outer strip, the ratio of the thickness of the inner envelope to the mean diameter of the inner envelope as a function of increasing attenuation within the attenuation range has a maximum value determined by the slope of a second straight line plot of thickness as a first coordinate against mean diameter as a second coordinate in a cartesian coordinate system, the slope of the second straight line plot being much higher than the slope of the first straight line plot.

12. A cable comprising:

a core having a plurality of spaced apart insulated electric conductors;

a copper envelope consisting of at least one copper strip and surrounding said core, the copper envelope providing electromagnetic field shielding within an attentuation range of 85 to 115 dB, the amount of attenuation in this range being dependent upon the thickness of the copper envelope and increasing monotonically with increasing thickness, the copper envelope extending in the longitudinal direction of the cable, the width of the copper strip being so chosen that its longitudinal edges are overlapped in the peripheral direction of the cable;

an electrically non-conductive layer surrounding the copper envelope; and a stainless steel envelope surrounding and enclosing the layer, the steel envelope extending in the longitudinal direction of the cable with abutting edges, said abutting edges of the steel envelope being welded together, the steel envelope being corrugated, the steel envelope increasing the viability of the cable when subjected to external high temperatures in such manner that the cable will retain its structural and electrical integrity when such external temperatures approach the melting point of stainless steel.

13. The cable of claim 1 wherein the inner envelope consists of a single copper strip, the ratio of the thickness of the inner envelope to the mean diameter of the inner envelope as a function of increasing attenuation within the attenuation range has a minimum value determined by the slope of a first straight line plot of thickness as a first coordinate against mean diameter as a second coordinate in a cartesian coordinate system.

14. A method for producing a cable with a core having at least one insulated conductor, an inner envelope in the form of at least one copper strip surrounding said core, and an outer envelope of a stainless steel strip surrounding the inner envelope, said method comprising the steps of:

(a) forming said copper strip in the longitudinal direction about the core in such manner that its longitudinal edges are overlapped in the peripheral direction of the cable;

(b) forming an insulating layer about the inner envelope;

(c) forming said stainless steel strip around the insulating layer in such manner that the outer envelope defines a tube-like structure with two parallel abutting edges extending in the longitudinal direction of the cable;

(d) welding said abutting edges together to form a welded seam on the outer envelope; and (e) corrugating the outer envelope in a circumferential direction.

15. The method of claim 14 wherein in step (a) the copper strip is drawn from a copper strip accumulator and in step (b) the steel strip is drawn from a steel strip accumulator and the strip is formed into a tube-like structure by a forming tool.

16. The method of claim 14 wherein the insulating layer is formed by an insulating foil.

17. The method of claim 14 wherein the insulating layer is formed as an outer coating of the copper strip.

* * * * *